US008523594B2

(12) United States Patent
Takeda et al.

(10) Patent No.: US 8,523,594 B2
(45) Date of Patent: Sep. 3, 2013

(54) CONNECTOR

(75) Inventors: Kazuaki Takeda, Yokkaichi (JP); Katsuya Uezono, Yokkaichi (JP); Takumi Hiraishi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 69 days.

(21) Appl. No.: 13/180,811

(22) Filed: Jul. 12, 2011

(65) Prior Publication Data

US 2012/0034805 A1 Feb. 9, 2012

(30) Foreign Application Priority Data

Aug. 6, 2010 (JP) ..... 2010-177311

(51) Int. Cl.
*H01R 13/627* (2006.01)

(52) U.S. Cl.
USPC ..... 439/352

(58) Field of Classification Search
USPC ..... 439/352, 595
See application file for complete search history.

(56) References Cited

U.S. PATENT DOCUMENTS

| | | | | |
|---|---|---|---|---|
| 6,068,512 | A | 5/2000 | Machida et al. | |
| 6,276,964 | B1 * | 8/2001 | Shinozaki | 439/595 |
| 2003/0054691 | A1 | 3/2003 | Machida et al. | |
| 2006/0035519 | A1 * | 2/2006 | Casses et al. | 439/592 |
| 2006/0141862 | A1 | 6/2006 | Machida et al. | |

FOREIGN PATENT DOCUMENTS

| | | |
|---|---|---|
| JP | 2005-166608 | 6/2005 |
| JP | 2006185872 | 7/2006 |

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A housing (10) is formed with jig insertion holes (20) penetrating through an outer wall (19) located at a side of deformation spaces (17) opposite to locking lances (14). Deformation restrictions (42) of a front retainer (40) are formed with guides (49) that are cut out to allow an unlocking jig inserted through the jig insertion hole (20) to reach the locking lance (14) when the front retainer (40) is at a retracted position and to position the unlocking jig in a width direction crossing both a resiliently deforming direction of the locking lances (14) and an inserting direction of terminal fittings (30) into cavities (13).

14 Claims, 9 Drawing Sheets

CONNECTOR

BACKGROUND OF THE INVENTION

1. Field of the Invention

The invention relates to a connector.

2. Description of the Related Art

Japanese Unexamined Patent Publication No. 2005-166608 discloses a connector with a housing and a cavity formed in the housing. A locking lance is cantilevered forward along an inner wall of the cavity and a deformation space allows the locking lance to deform away from the cavity. A terminal fitting can be inserted into the cavity from behind and causes the locking lance to deflect into the deformation space. The locking lance then returns resiliently to engage the terminal fitting and hold the terminal fitting in the cavity. A front retainer is mounted to the housing after the terminal fitting is inserted and a deformation restricting portion of the front retainer enters the deformation space to prevent the locking lance from deforming out of engagement with the terminal fitting and to retain the terminal fitting reliably.

The terminal fitting can be withdrawn from the housing by retracting the deformation restricting portion from the deformation space. An unlocking jig then is inserted into the housing from the front to deform the locking lance out of engagement with the terminal fitting so that the terminal fitting can be pulled out backward. However, the terminal fitting is present near the locking lance and a contact portion for contacting a mating terminal is formed at a front end portion of the terminal fitting. This contact portion may be damaged by the unlocking jig.

The invention was developed in view of the above situation and an object thereof is to prevent an unlocking jig from damaging a terminal fitting.

SUMMARY OF THE INVENTION

The invention relates to a connector with at least one terminal fitting. A contact portion is formed near a front end of the terminal fitting for contacting a mating terminal. The connector also has a housing with a cavity and the terminal fitting can be inserted into the cavity from behind. A locking lance is cantilevered forward along an inner wall of the cavity. The locking lance normally is at a locking position where the locking lance can lock the terminal fitting in a retained state. However, the locking lance is resiliently deformable to an unlocking position where the locking lance is disengaged from the terminal fitting. A deformation space is formed in the housing to allow resilient deformation of the locking lance to the unlocking position. A front retainer is mounted to the housing from the front and includes a deformation restriction that projects back substantially along the inserting direction. The front retainer is movable between a restricting position and a retracted position. The deformation restriction enters the deformation space to restrict the deformation of the locking lance when the front retainer is at the restricting position. However, the deformation restriction is retracted forward of the deformation space to allow deformation of the locking lance when the front retainer is at the retracted position. The locking lance is deformed from the locking position to the unlocking position by an unlocking jig that can be inserted into the housing with the front retainer at the retracted position. A jig insertion hole penetrates an outer wall at a side of the deformation space substantially opposite the locking lance. The deformation restriction has at least one guide configured to allow the unlocking jig inserted through the jig insertion hole to reach the locking lance with the front retainer at the retracted position and positions the unlocking jig in a width direction crossing both a resiliently deforming direction of the locking lance and an inserting direction of the terminal fitting into the cavity. Thus, the tab of the terminal fitting will not be damaged by the unlocking jig. Further, the guide reliably guides the unlocking jig in the width direction to the locking lance so that operability is good.

The guide preferably is open at the rear end of the deformation restriction. Thus, a movable range of the unlocking jig is wider in forward and backward directions as compared with a guide that is closed at the rear end of the deformation restriction.

An opening area of the guide in the width direction preferably is within substantially the entire width range of the locking lance. Thus, the unlocking jig will not disengage from the locking lance in the width direction and the locking lance can be deformed reliably.

The deformation restriction preferably has at least one closing portion for at least partly closing the jig insertion hole when the front retainer is at the restricting position. Thus, external matter will not enter the housing through the jig insertion hole.

The deformation restriction preferably has one or more supports for supporting the terminal fitting when the front retainer is at the restricting position and to stabilize the posture of the terminal fitting. More particularly, the deformation restriction may comprise a main portion, one or more supports and one or more reinforcements. A width of the deformation restriction may substantially equal the width of the deformation space. An outer surface of the support may be more inward than an outer surface of the main portion in the width direction, but the outer surface of the reinforcement preferably is substantially flush and continuous with the outer surface of the main portion. A front end of the support preferably is connected to a supporting wall of the front retainer and a rear end of the support preferably is before a rear end of the main portion. A front end of the reinforcement preferably is connected to the supporting wall, and a rear end is before a rear end of the main portion and/or slightly behind the rear end of the supports.

A front end of the main portion preferably defines a closing portion for at least partly closing the jig insertion hole when the front retainer is at the restricting position. More particularly, with the front retainer at the restricting position, the supporting wall closes an opening at the front end of the cavity and forms a front stop of the cavity for stopping the properly inserted terminal fitting at its front end position in the cavity.

The guide preferably is substantially bilaterally symmetric and a center of the guide substantially coincides with a center of the deformation space and the locking lance.

A formation area of the jig insertion hole in the width direction preferably is smaller than a width of the locking lance.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
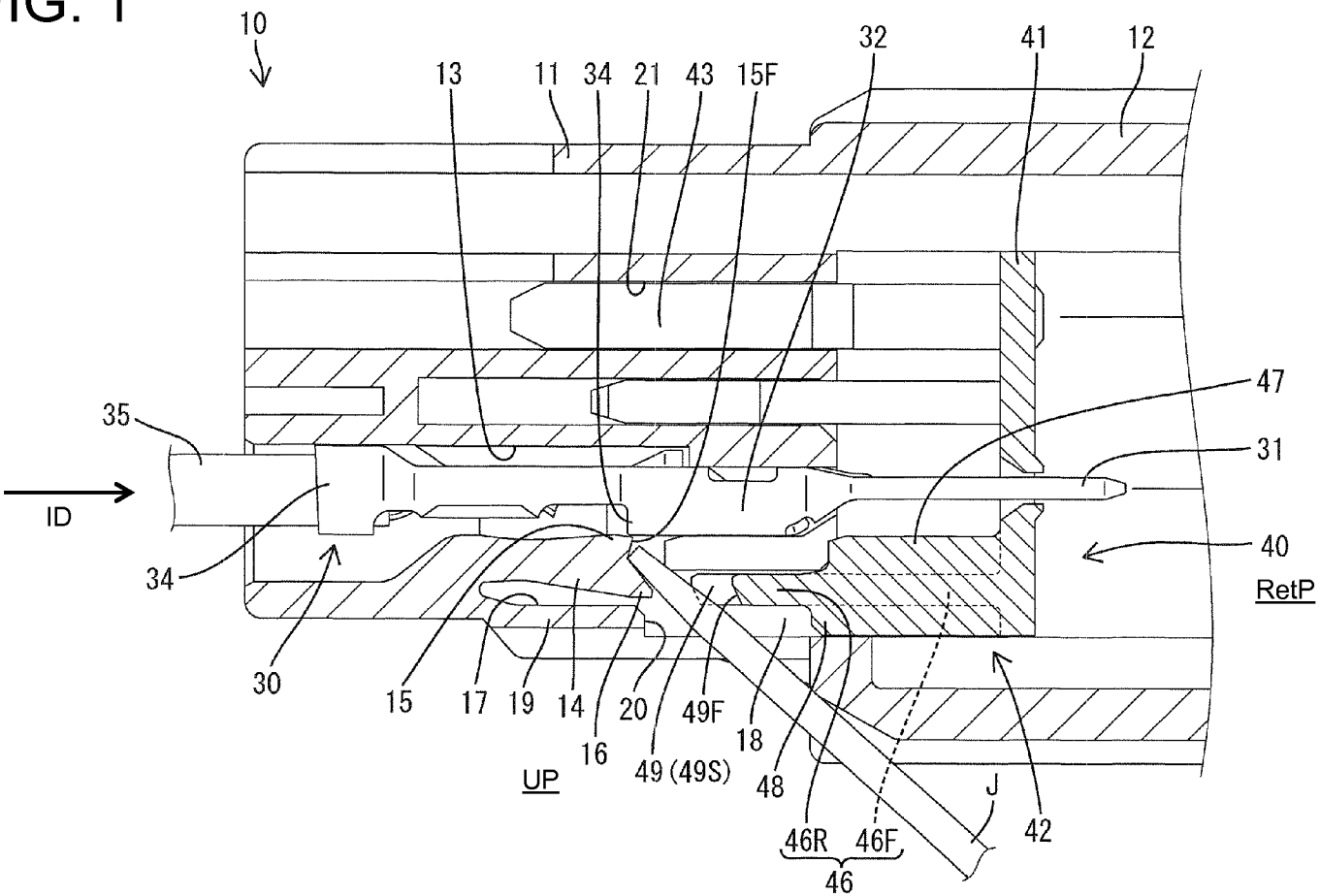
FIG. 1 is a section showing a state where a locking lance is resiliently deformed by an unlocking jig in one embodiment.

A connector in accordance with the invention includes a synthetic resin housing identified by the numeral 10 in FIGS. 1-7. The housing 10 is molded unitarily of synthetic resin and includes a substantially block-shaped terminal holding portion 11 and a rectangular tubular receptacle 12 that extends forward from the outer periphery of the front end of the terminal holding portion 11. Cavities 13 penetrate the terminal holding portion 11 in forward and backward directions at upper and lower stages and an insertion opening is defined at the rear end of each cavity 13 so that terminal fittings 30 can be inserted into the respective cavities from behind (left side in FIGS. 1 to 6) and along an insertion direction ID. A locking lance 14 is cantilevered forward along the lower wall of each cavity 13 in the lower stage. The front end of the locking lance 14 is behind the front end of the terminal holding portion 11 and behind the front end of the cavity 13.

A locking projection 15 is formed on the upper surface of the locking lance 14 and projects up and in toward the cavity 13. A locking surface 15F is formed on the front of the locking projection 15 and rearward of the extreme front end of the locking lance 14. The locking surface 15F is aligned substantially perpendicular to the inserting direction ID of the terminal fitting 30 into the cavity 13. A jig receiving portion 16 is defined at the front part of the locking lance 14 before the locking projection 15 and can be engaged by an unlocking jig J.

Figure 2:
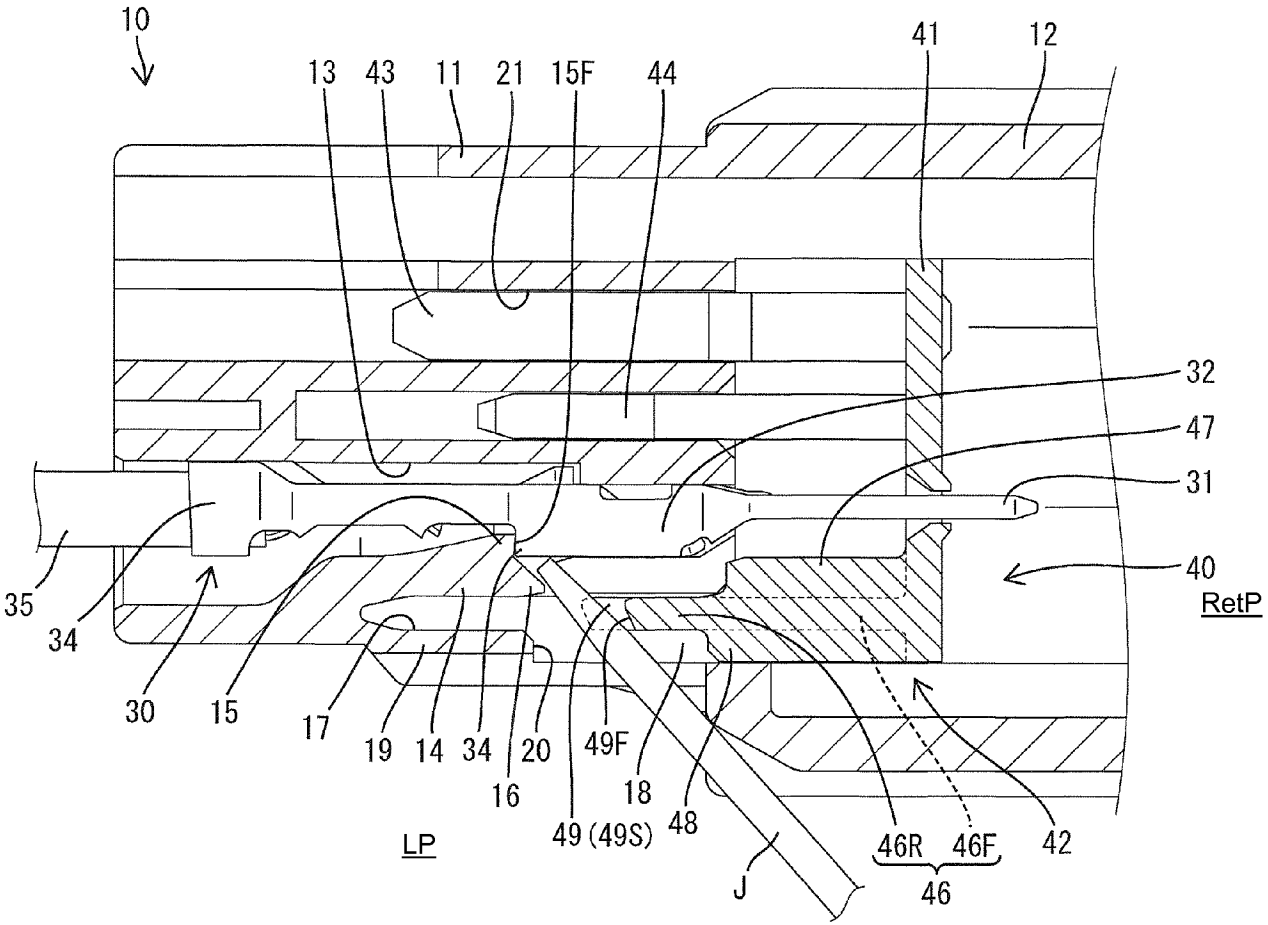
FIG. 2 is a section showing the unlocking jig inserted in a housing.
Figure 3:
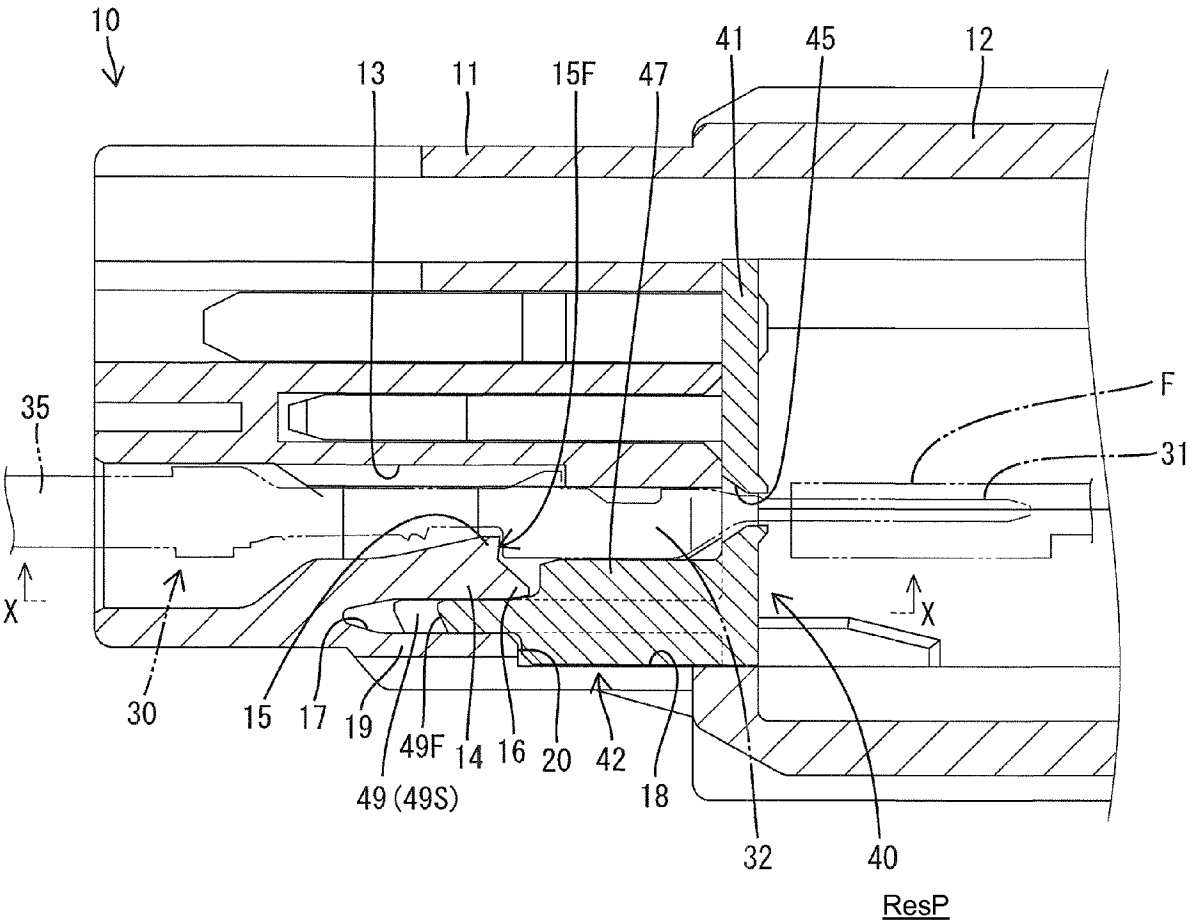
FIG. 3 is a section showing a front retainer at a restricting position.
Figure 5:
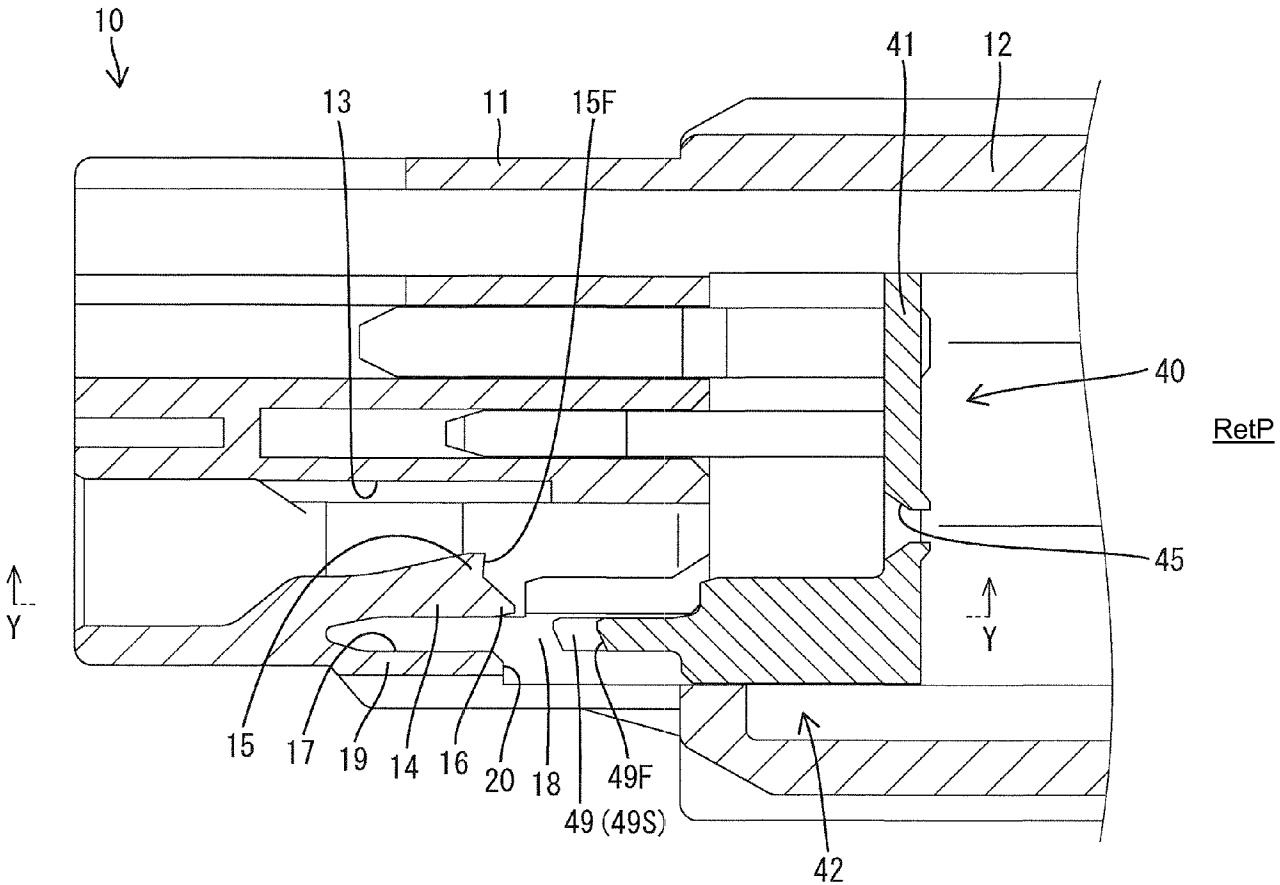
FIG. 5 is a section showing the front retainer at a retracted position.

The locking lance 14 normally is held at a locking position LP shown in FIGS. 2, 3 and 5 by the rigidity of the locking lance 14 itself. However, the locking lance 14 is resiliently deformable to an unlocking position UP (see FIG. 1) below the locking position LP while being inclined with the rear end of the locking lance 14 as a support. A displacing direction of the locking projection 15 during the resilient deformation from the locking position LP to the unlocking position UP is substantially perpendicular to the inserting direction ID of the terminal fitting 30 into the cavity 13. The locking projection 15 is in the cavity 13 and along insertion path for the terminal fitting 30 when the locking lance 14 is at the locking position LP. However, the locking projection 15 is retracted to a position offset from the cavity 13 and out of the insertion path for the terminal fitting 30 when the locking lance 14 is displaced to the unlocking position UP.

Figure 4:
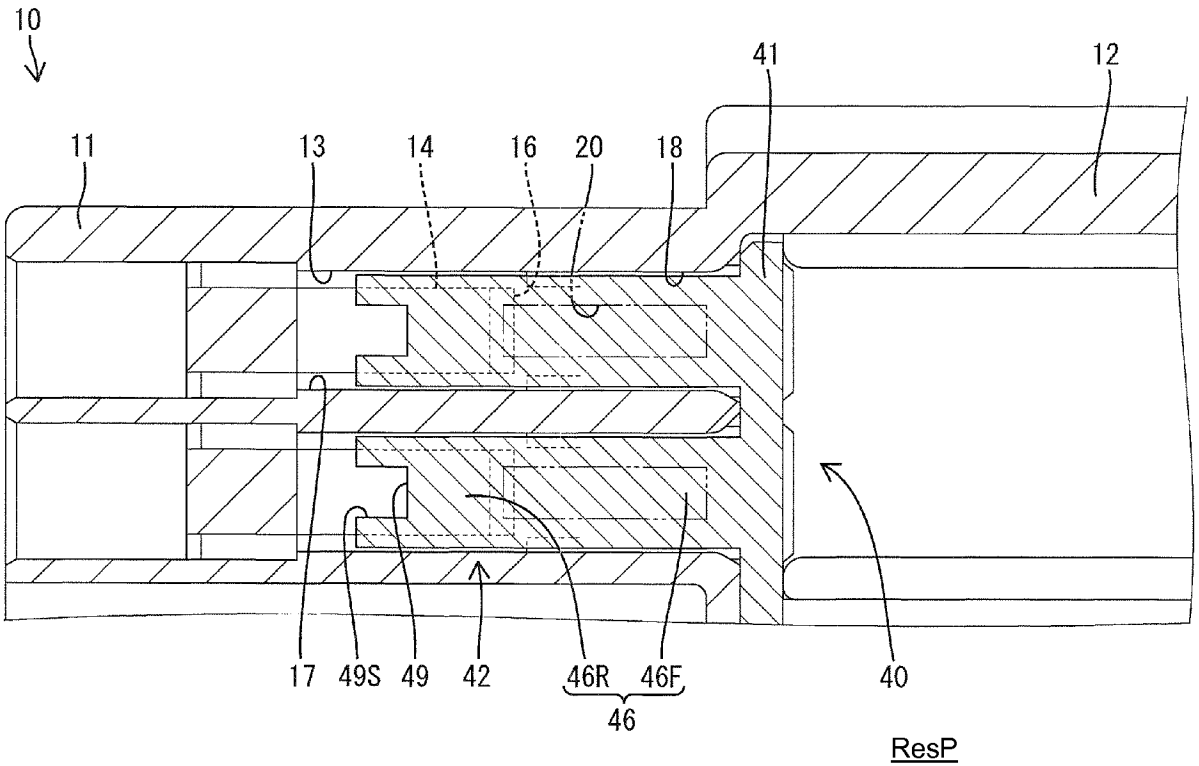
FIG. 4 is a section along X-X of FIG. 3.
Figure 6:
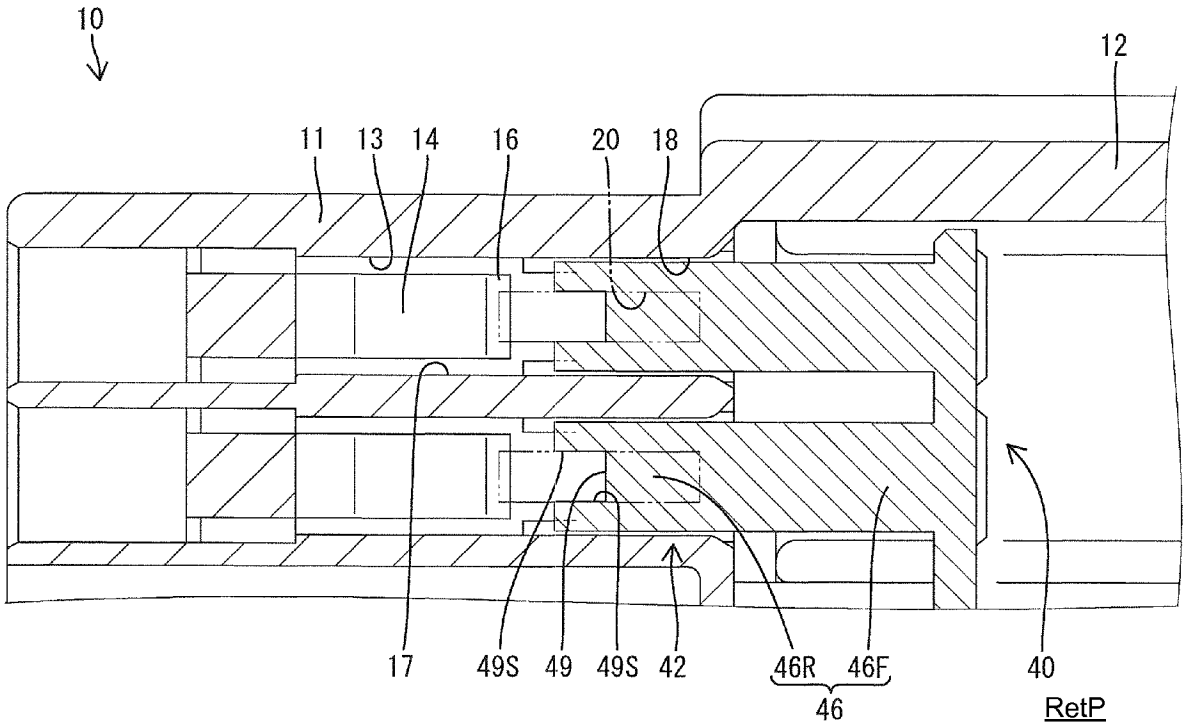
FIG. 6 is a section along Y-Y of FIG. 5.
Figure 7:
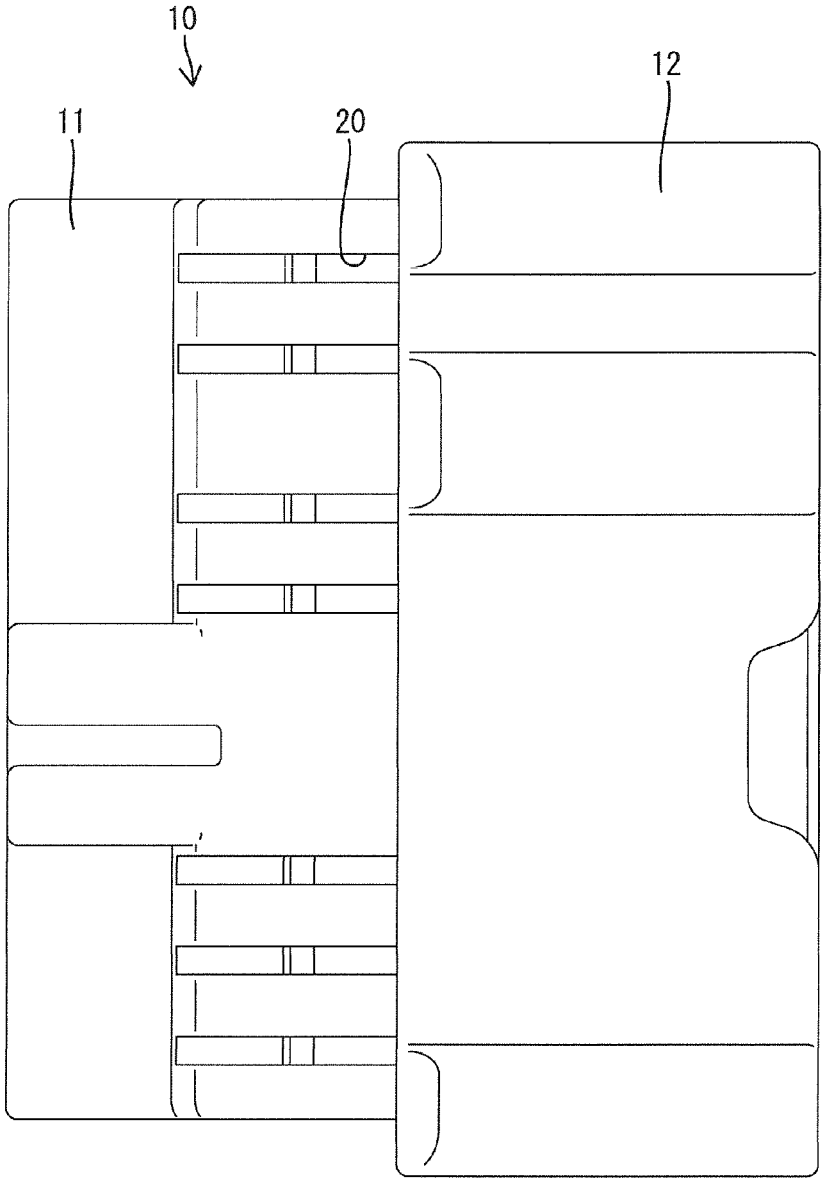
FIG. 7 is a bottom view of the housing.

As shown in FIGS. 1 to 3, deformation spaces 17 are formed in the housing 10 and correspond individually to the respective locking lances 14 so that the locking lances 14 can deform resiliently to the unlocking positions UP. As shown in FIGS. 4 and 6, the centers of the deformation spaces 17 substantially coincide with centers of the locking lances 14 in a width direction crossing both the inserting direction ID of the terminal fittings 30 into the cavities 13 and a resiliently deforming direction of the locking lances 14. The deformation spaces 17 are wider than the locking lances 14. A mold removal space 18 is formed in the housing 10 before the deformation spaces 17 and the locking lances 14 and is open in the front end surface of the terminal holding portion 11. The mold removal space 18 is formed as the deformation spaces 17 and the locking lances 14 are formed by a mold and also functions as a space for accommodating the front retainer 40. Further, the mold removal space 18 is sufficiently wide to correspond to all of the locking lances 14 and deformation spaces 17.

An outer wall 19 is located at a side of the deformation spaces 17 opposite the locking lances 14 in the resiliently deforming direction of the locking lances 14 and hence separates the outer surface of the housing 10 from the deformation spaces 17. Jig insertion holes 20 penetrate the outer wall 19 and define rectangles that are long and narrow in forward and backward directions. As shown in FIGS. 4 and 6, the centers of the jig insertion holes 20 substantially coincide with centers the locking lances 14 and the deformation spaces 17 in the width direction. However, the jig insertion holes 20 are narrower than the locking lances 14. The jig insertion holes 20 extend in forward and backward directions from positions near the front end of the terminal holding portion 11 (mold removal space 18) to positions slightly before the locking surfaces 15F at the front ends of the locking projections 15. Thus, the rear ends of the jig insertion holes 20 are in formation areas of the jig receiving portions 16 in forward and backward directions.

The housing 10 also has locking lances 14, deformation spaces 17 and at least one mold removal space 18 that correspond to the cavities 13 at the upper stage. Since all of the locking lances 14, the deformation spaces 17, the mold removal space 18 and jig insertion holes 20 at the upper stage are vertically symmetrical to the locking lances 14, the deformation spaces 17, the mold removal space 18 and the jig insertion holes 20 at the lower stage, they are neither shown nor described.

Each terminal fitting 30 is formed by bending, folding and/or embossing a conductive metal plate material punched or cut out into a specified shape and, as shown in FIGS. 1 to 3, is long and narrow in forward and backward directions. The terminal fitting 30 is a male terminal with a long and narrow tab 31 at its front end for contacting a mating female terminal F. The terminal fitting 30 includes a rectangular tubular main portion 32 at the rear end of the tab 31 and a wire connection portion comprising at least one crimping barrel 33 at the rear end of the main portion 32. A front end portion of a wire 35 is fixed and connected electrically conductively to the crimping portion 33. The rear end edge of the main portion 32 defines a locking portion 34 for locking the locking projection 15 of the locking lance 14 from behind.

Figure 8:
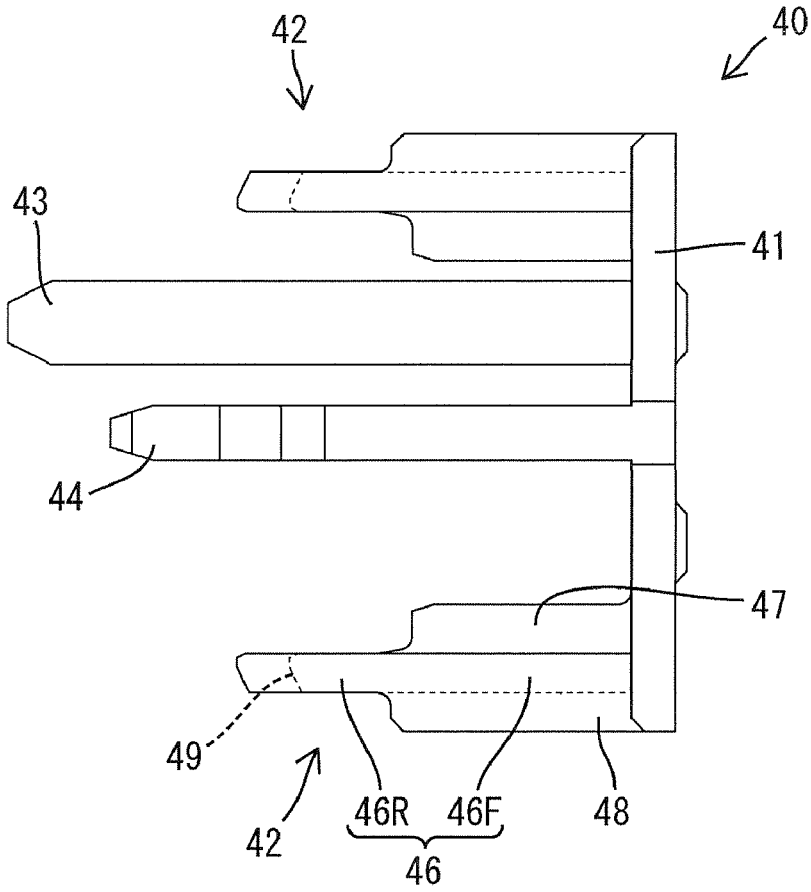
FIG. 8 is a side view of the front retainer.
Figure 9:
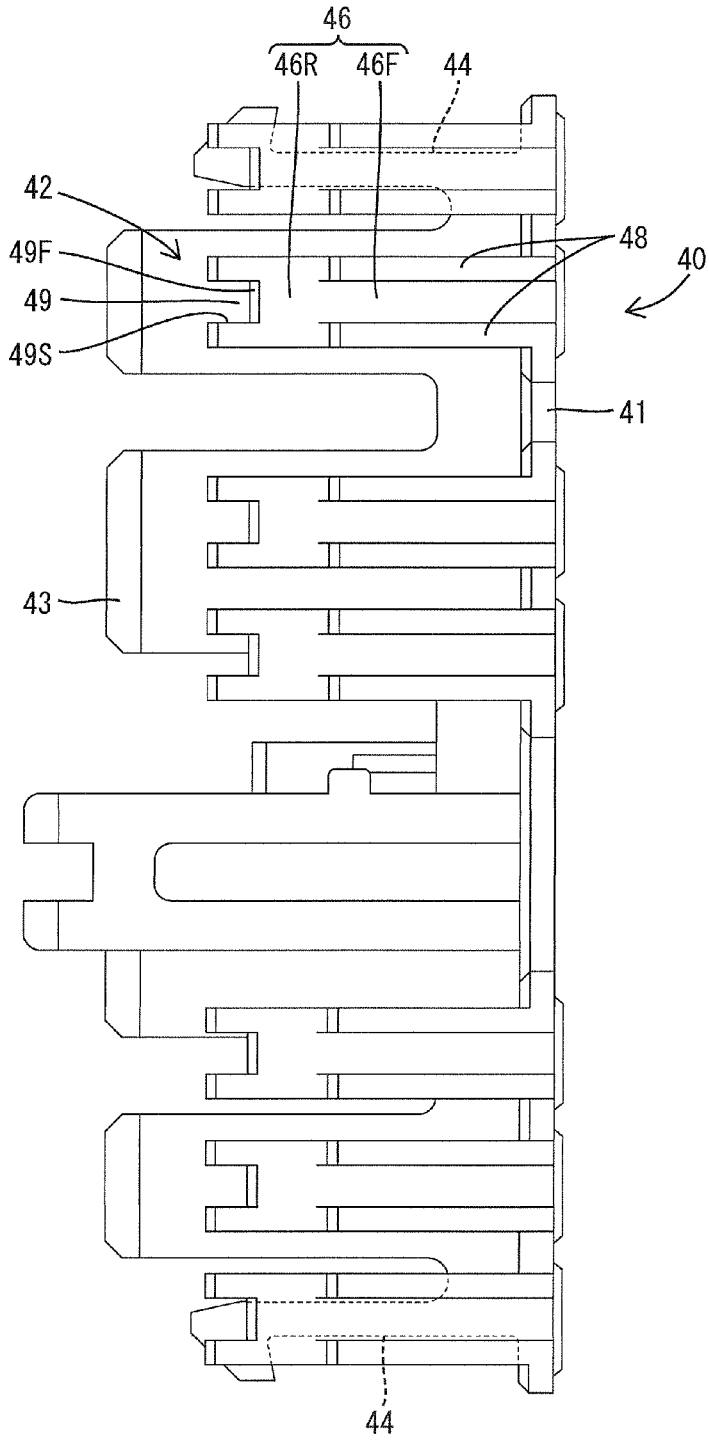
FIG. 9 is a bottom view of the front retainer.

The connector also includes a front retainer 40 that is formed unitarily of synthetic resin, as shown in FIGS. 8 and 9. The front retainer 40 includes a supporting wall 41. Deformation restrictions 42, guides 43 and lateral resilient locking pieces 44 all cantilever back from the supporting wall 41. The front retainer 40 is mounted into the terminal holding portion 11 of the housing 10 from the front. More particularly, the guides 43 are fit into respective guiding holes 21 of the terminal holding portion 11 so that the front retainer 40 is moved along a predetermined mounting path while being positioned in the vertical and lateral directions with respect to the housing 10.

The front retainer 40 is movable in the housing 10 in forward and backward in directions between a retracted position RetP shown in FIGS. 1, 2, 5 and 6 and a restricting position ResP located behind the retracted position RetP in a mounting direction of the front retainer 40, as shown in FIGS. 3 and 4. The front retainer 40 is held at the retracted position RetP and at the restricting position ResP by engaging the resilient locking pieces 44 with locking projections (not shown) of the terminal holding portion 11.

The supporting wall 41 closes the openings at the front ends of the cavities 13 when the front retainer 40 is at the restricting position ResP and forms the front walls of the cavities 13 for stopping the properly inserted terminal fittings 30 at their front end positions in the cavities 13. Through holes 45 are formed at positions of the supporting wall 41 corresponding to the cavities 13 for allowing the passage of the tabs 31.

The deformation restrictions 42 are aligned at the upper and/or lower stages. The deformation restrictions 42 at the upper stage are vertically symmetrical to the deformation restrictions 42 at the lower stage. Hence, only the deformation restrictions at the lower stage are described. The deformation restrictions 42 are provided to correspond to the respective locking lances 14 and, as shown in FIGS. 4 and 6, the centers of the deformation restrictions 42 substantially coincide with centers of the locking lances 14 and the deformation spaces 17 in the width direction. Each deformation restriction 42 has a substantially horizontal plate 46. Two bilaterally symmetric supports 47 project from the upper surface of the plate 46 and define long narrow ribs that extend in forward and backward directions. Additionally, two bilaterally symmetric reinforcements 48 project from the lower surface of the plate 46 and define long narrow ribs that extend in forward and backward directions.

The width of the deformation restriction 42 substantially equals the width of the deformation space 17. More particularly, the outer surfaces of the supports 47 are more inward than the outer surfaces of the plate 46 in the width direction, but the outer surfaces of the reinforcements 48 are substantially flush and continuous with outer surfaces of the plate 46. The front ends of the supports 47 are connected to the supporting wall 41 and the rear ends of the supports 47 are located before the rear end of the plate 46. More particularly, the front ends of the reinforcements 48 are connected to the support 41, and the rear ends thereof are located before the rear end of the plate 46 and slightly behind the rear ends of the supports 47. The thickness from the upper edges of the supports 47 to the lower edges of the reinforcements 48 of the deformation restriction 42 is substantially equal to a height difference between the bottom surface of the deformation space 17 to the bottom of the cavity 13.

The reinforcements 48 slide on the bottom surface of the mold removal space 18 in the process of moving the front retainer 40 between the retracted position RetP and the restricting position ResP. The supports 47 are located before the front ends of the cavities 13 when the front retainer 40 is at the retracted position RetP, but the supports 47 are located at front ends (before the locking lances 14) in the cavities 13 and the upper end edges of the supports 47 are at substantially the same heights as the bottom surfaces of the cavities 13 when the front retainer 40 is at the restricting position ResP.

A closing portion 46F is defined at a part of each plate 46 before the rear ends of the supports 47 and is connected to the support 41 for closing the jig insertion hole 20. A restriction 46R is defined at a part of each plate 46 before the rear ends of the supports 47 and is fit into the deformation space 17 to restrict deformation of the locking lance 14. The rear end edges of the deformation restrictions 42 are slightly before the front ends of the locking lances 14 as shown in FIGS. 1, 2, 5 and 6. Therefore the restrictions 46R are retracted forward from the deformation spaces 17. The restrictions 46R fit in the deformation spaces 17 between the locking lances 14 and the outer wall 19 when the front retainer 40 is at the restricting position ResP, as shown in FIGS. 3 and 4. Thus, the locking lances 14 being resiliently deformed from the locking position LP to the unlocking position UP come into contact with the upper or inner surfaces of the restrictions 46R to prevent resilient deformations.

The front retainer 40 is held at the retracted position RetP and the locking lances 14 are kept on standby and in a state to be resiliently deformable to the unlocking positions UP prior to inserting the terminal fittings 30 into the cavities 13. The main portion 32 interferes with the locking projection 15 during the insertion of the terminal fitting 30 in this state. Therefore the locking lance 14 is deformed resiliently toward the deformation space 17 and is displaced to the unlocking position UP. The main portion 32 passes the locking projection 15 when the terminal fitting 30 reaches a proper insertion position and the locking lance 14 resiliently returns to the locking position LP so that the locking projection 15 engages the locking portion 34 of the terminal fitting 30 from behind. This locking action of the locking lance 14 prevents the terminal fitting 30 from being withdrawn backward.

The front retainer 40 is pushed to the restricting position ResP after the terminal fittings 30 are inserted. Thus, the restricting portions 46R enter the deformation spaces 17 to restrict the resilient deformations of the locking lances 14 and to ensure that the locking lances 14 lock the terminal fittings 30 more reliably. The supports 47 support the main portions 32 from below to stabilize the postures of the terminal fittings 30 when the front retainer 40 is moved to the restricting position ResP. At this time, the reinforcements 48 are below the supports 47 and are in contact with the bottom surface of the mold removal space 18. Thus, the supports 47 cannot be displaced down and the terminal fittings 30 are supported reliably.

Each restriction 46R is formed with a guide 49 that defines a substantially rectangular opening in a substantially widthwise central part. The guide 49 enables an unlocking jig J inserted through the jig insertion hole 20 to reach the locking lance 14 when the front retainer 40 is at the retracted position RetP. The guide 49 is open at the rear end of the restriction 46R (deformation restricting portion 42) so that a rear extending end of the restriction 46R is forked. The guide 49 has opposed left and right guide surfaces 49S that substantially face each other. Additionally, the guide 49 is bilaterally symmetric and, accordingly, the center of the guide 49 coincides with the center of the restriction 46R (deformation space 17 and locking lance 14). The opening area (width) of the guide 49 is equal to the opening width of the jig insertion hole 20 and is accommodated within the entire width range of the locking lance 14.

The formation area of the guide 49 in forward and backward directions is behind the front end of the restriction 46R (rear ends of the supports 47). A front end surface 49F of the guide 49 inclines in an overhanging or undercut manner toward the back so that the front opening edge of the guide 49 in the lower surface of the restriction 46R is before the front opening edge of the guide 49 in the upper surface of the restriction 46R. The cutout area of the guide 49 is before the locking lance 14 and within the opening area of the jig insertion hole 20 in forward and backward directions when the front retainer is at the retracted position RetP. The cutout area of the guide 49 is accommodated substantially entirely in the deformation space 17 when the front retainer 40 is at the restricting position ResP.

The terminal fitting 30 can be withdrawn from the housing 10 by initially moving the front retainer 40 from the restricting position ResP to the retracted position RetP. Thus, the restriction 46R is forward of the deformation space 17 and the guide 49 aligns with the jig insertion hole 20. The long narrow unlocking jig J then is inserted obliquely up and back through the jig insertion hole 20 in the housing 10 and through the guide 49 to engage the upper surface of the jig receiving portion 16 of the locking lance 14, as shown in FIG. 2. The unlocking jig J then is inclined like a lever with the rear end of the outer surface of the receptacle 12 as a fulcrum, as shown in FIG. 1, so that the jig receiving portion 16 is pressed down and out away from the cavity 13 and the locking lance 14 is deformed resiliently to the unlocking position UP. This deformation of the locking lance 14 releases the terminal fitting 30 from the locked state so that the terminal fitting 30 may be then pulled backward by holding the wire 35.

The unlocking jig J is inserted into the housing 10 in a direction crossing the inserting direction ID of the terminal fitting 30. A position reached by the unlocking jig J in the housing 10 is behind the rear end of the tab 31 in forward and backward directions. Therefore, the tab 31 of the terminal fitting 30 will not be damaged by the unlocking jig J.

The unlocking jig J is inserted through the guide 49 to reach the jig receiving portion 16 of the locking lance 14 when unlocking the locking lance 14. The guide 49 separates the restriction 46R into a forked shape and opposite left and right guide surfaces 49S thereof are located at the left and right sides of the unlocking jig J. Thus, the unlocking jig J can reliably reach the locking lance 14 without being displaced in the width direction.

The guide 49 is open at the rear end of the deformation restricting portion 42. Thus, a movable range of the unlocking jig J in forward and backward directions is wider and operability is better as compared with a guide with a closed at the rear end.

The lateral opening area of the guide 49 is within substantially the entire width range of the locking lance 14. Thus, the unlocking jig J will not disengage from the locking lance 14 in the width direction and the locking lance 14 can be deformed reliably.

Each deformation restriction 42 has the closing portion 46F for closing the jig insertion hole 20 when the front retainer 40 is at the restricting position. Thus, external matter cannot enter the housing 10 through the jig insertion holes 20 when the terminal fittings 30 are retained by moving the front retainer 40 to the restricting position.

The invention is not limited to the above described and illustrated embodiment. For example, the following embodiments are also included in the technical scope of the present invention.

A male terminal with a long and narrow tab is described in the above embodiment. However, the invention is also applicable to a female terminal with a terminal connecting portion in the form of a rectangular tube at a front end and a resilient contact piece in the terminal connecting portion for contacting a mating terminal.

Each guide is open at the rear end edge of the deformation restricting portion in the above embodiment. However, the guide may be a closed window.

The opening area of each guide in the width direction is within the entire width range of the locking lance in the above embodiment. However, a part of the opening area of the guide may be outside the entire width range of the locking lance.

Each above-described deformation restriction has the closing portion for closing the jig insertion hole when the front retainer is at the restricting position. However, the jig insertion hole may be left open when the front retainer is at the restricting position.

What is claimed is:

1. A connector, comprising:

at least one terminal fitting;

a housing with opposite front and rear ends spaced apart along an inserting direction, at least one cavity for receiving the terminal fitting along the insertion direction, at least one locking lance cantilevered forward along an inner wall of the cavity and being resiliently deflectable from a locking position where the locking lance locks the terminal fitting in the cavity and an unlocking position where the locking lance is disengaged from the terminal fitting, at least one deformation space disposed to allow deformation of the locking lance to the unlocking position, at least one jig insertion hole penetrating an outer wall of the housing at a side of the deformation space substantially opposite the locking lance and at a position rearward of the front end of the housing; and a front retainer mounted to the front end of the housing and including at least one deformation restriction projecting substantially along the inserting direction, the front retainer being movable between a restricting position where the deformation restriction is in the deformation space to restrict deformation of the locking lance and retracted position where the deformation restriction is forward of the deformation space to allow deformation of the locking lance, the deformation restriction having at least one guide substantially aligned with the jig insertion hole when the front retainer is at the retracted position, wherein:

the locking lance is deformable from the locking position to the unlocking position by an unlocking jig inserted through the guide and the jig insertion hole when the front retainer is at the retracted position.

2. The connector of claim 1, wherein the deformation restriction is disposed and configured to position the unlocking jig in a width direction crossing both a deforming direction of the locking lance and an inserting direction of the terminal fitting into the cavity.

3. The connector of claim 1, wherein the guide is open at a rear end of the deformation restricting portion.

4. The connector of claim 1, wherein an opening area of the guide in a width direction is within substantially an entire width range of the locking lance.

5. The connector of claim 1, wherein the deformation restriction has at least one closing portion for at least partly closing the jig insertion hole when the front retainer is at the restricting position.

6. The connector of claim 1, wherein the jig insertion hole is narrower than the locking lance.

7. The connector of claim 1, wherein the terminal fitting is a male terminal fitting with a forwardly projecting tab.

8. A connector, comprising:

at least one terminal fitting;

a housing with opposite front and rear ends spaced apart along an inserting direction, at least one cavity for receiving the terminal fitting along the insertion direction, at least one locking lance cantilevered forward along an inner wall of the cavity and being resiliently deflectable from a locking position where the locking lance locks the terminal fitting in the cavity and an unlocking position where the locking lance is disengaged from the terminal fitting, at least one deformation space disposed to allow deformation of the locking lance to the unlocking position, at least one jig insertion hole penetrating an outer wall of the housing at a side of the deformation space substantially opposite the locking lance; and a front retainer mounted to the front end of the housing and including at least one deformation restriction projecting substantially along the inserting direction, the front retainer being movable between a restricting position where the deformation restriction is in the deformation space to restrict deformation of the locking lance and retracted position where the deformation restriction is forward of the deformation space to allow deformation of the locking lance, the deformation restriction having at least one support supporting the terminal fitting when the front retainer is at the restricting position to stabilize a posture of the terminal fitting and at least one guide substantially aligned with the jig insertion hole when the front retainer is at the retracted position, wherein:

the locking lance is deformable from the locking position to the unlocking position by an unlocking jig inserted through the guide and the jig insertion hole when the front retainer is at the retracted position.

9. A connector comprising:

at least one terminal fitting;

a housing with opposite front and rear ends spaced apart along an inserting direction, at least one cavity for receiving the terminal fitting along the insertion direction, at least one locking lance cantilevered forward along an inner wall of the cavity and being resiliently deflectable from a locking position where the locking lance locks the terminal fitting in the cavity and an unlocking position where the locking lance is disengaged from the terminal fitting, at least one deformation space disposed to allow deformation of the locking lance to the unlocking position, at least one jig insertion hole penetrating an outer wall of the housing at a side of the deformation space substantially opposite the locking lance; and a front retainer mounted to the front end of the housing and including at least one deformation restriction projecting substantially along the inserting direction, the front retainer being movable between a restricting position where the deformation restriction is in the deformation space to restrict deformation of the locking lance and retracted position where the deformation restriction is forward of the deformation space to allow deformation of the locking lance, the deformation restriction having a main portion, at least one support and at least one reinforcement, a width of the deformation restriction being substantially equal to a width of the deformation space and at least one guide substantially aligned with the jig insertion hole when the front retainer is at the retracted position, wherein:

the locking lance is deformable from the locking position to the unlocking position by an unlocking jig inserted through the guide and the jig insertion hole when the front retainer is at the retracted position.

10. The connector of claim 9, wherein a front end part of the main portion functions as a closing portion for at least partly closing the jig insertion hole when the front retainer is at the restricting position.

11. The connector of claim 9, wherein with the front retainer located at the restricting position, the supporting wall is located to close an opening at the front end of the cavity and at least partly forms a front stop of the cavity for stopping the terminal fitting at a front end position in the cavity.

12. The connector of claim 9, wherein an outer surface of the support is more inward than an outer surface of the main portion in a width direction, and the outer surface of the reinforcement is substantially flush and continuous with an outer surface of the main portion.

13. The connector of claim 12, wherein a front end of the support is connected to a supporting wall of the front retainer, and a rear end of the support is located before a rear end of the main portion.

14. The connector of claim 13, wherein a front end of the reinforcement is connected to the supporting wall, and a rear end thereof is located before a rear end of the main portion and slightly behind the rear end of the support.

* * * * *